United States Patent [19]

Falk et al.

[11] 3,938,362

[45] Feb. 17, 1976

[54] APPARATUS FOR THE PLASTIC WORKING OF MATERIAL

[75] Inventors: Curt Gunnar Falk, Sollentuna; Per-Olof Strandell, Taby; Karl Lennart Sundberg, Spanga, all of Sweden

[73] Assignee: AB Metalform, Stockholm, Sweden

[22] Filed: Feb. 12, 1974

[21] Appl. No.: 441,819

[30] Foreign Application Priority Data

Feb. 12, 1973 Sweden ..... 7301951

[52] U.S. Cl. ..... 72/225; 72/237; 72/238; 100/168

[51] Int. Cl.[2] ..... B21B 13/10; B21B 31/02

[58] Field of Search ..... 72/224, 225, 245, 246, 72/237, 179, 238, 239, 199, 182, 181, 456, 180, 160, 164; 29/1.5; 408/234; 100/168

[56] References Cited

UNITED STATES PATENTS

| | | | |
|---|---|---|---|
| 412,852 | 10/1889 | Kennedy et al. | 72/225 |
| 511,422 | 12/1893 | Haskin | 72/164 |
| 1,431,668 | 10/1922 | Kennedy | 72/239 |
| 2,072,831 | 3/1937 | Solenberger | 72/237 X |
| 2,907,369 | 10/1959 | Brauer | 72/160 |
| 3,456,510 | 7/1969 | De Vlieg et al. | 29/1.5 UX |
| 3,559,432 | 2/1971 | Rastelli | 72/19 |

*Primary Examiner*—Milton S. Mehr
*Attorney, Agent, or Firm*—Stevens, Davis, Miller & Mosher

[57] ABSTRACT

There is provided an apparatus for plastic working of material, comprising a lower portion carrying a lower tool and upstanding bars, an upper portion in the form of a carriage mounted on the bars for gliding movement along said bars and carrying an upper tool intended for co-action with the lower tool, cylinder and ram means for displacing the carriage along the bars, and expander sleeves for fixing the carriage to the bars in an optional position of displacement.

10 Claims, 6 Drawing Figures

Figure 1:
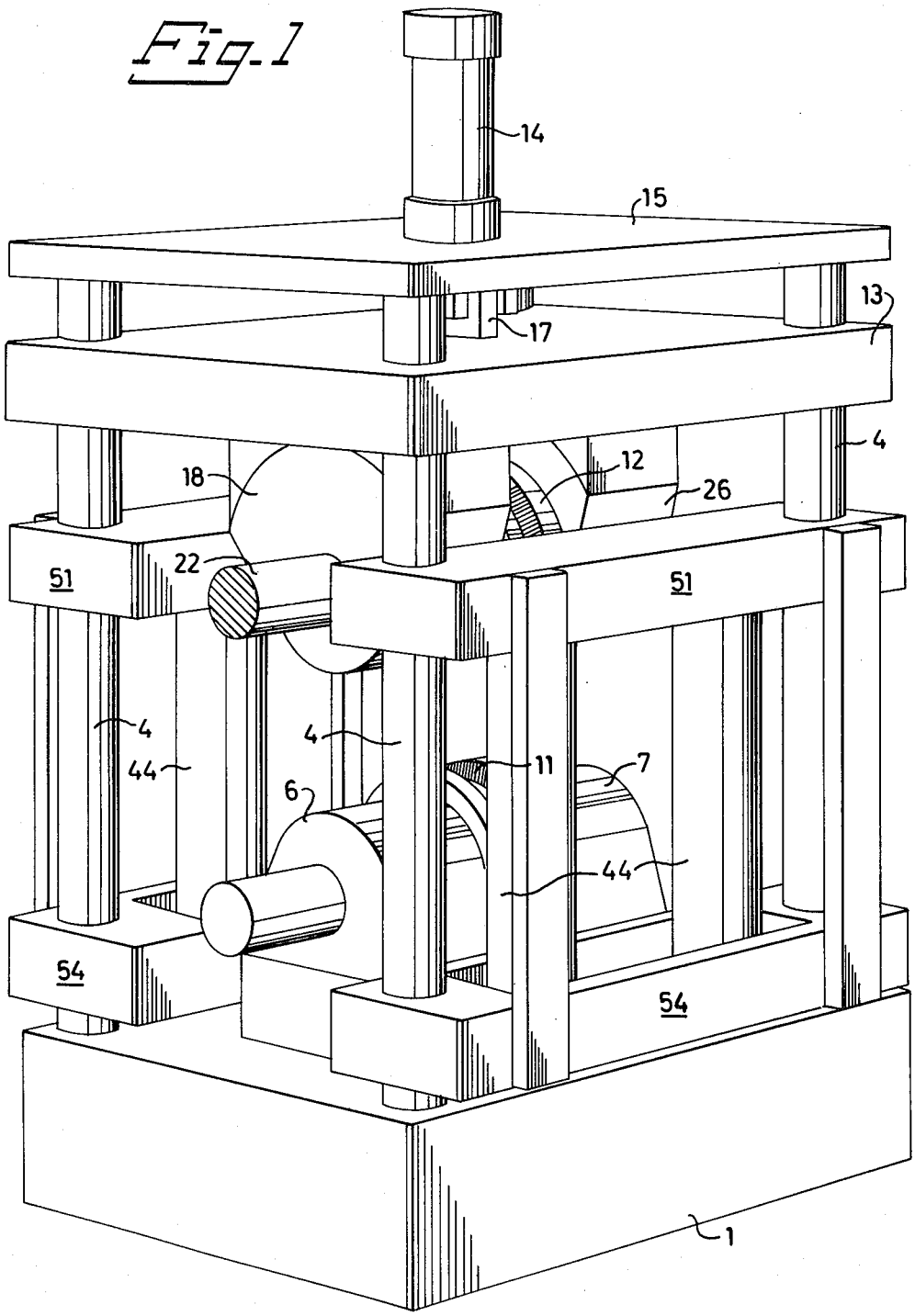

14
15
16
17
4
13
35
12
51
44
44
4
55
55
54
2
11
59
59
5
60
60
53
1

14
15
16
16
4
17
29
IV
43
36
13
42
27
26
28
52
48
50
51
49
55
44
12
44
46
55
47
IV
45
4
11
7
57
54'
54'
54
9
56
3
59
58
5
2
8
60
10
1
53

107
106
105
108
111
111
114
109
113
115
112
110
116
102
102
104
101
103

APPARATUS FOR THE PLASTIC WORKING OF MATERIAL

The present invention relates to an apparatus for the plastic working of material, especially a rolling mill or press. In present conventional engineering, a rolling mill consists of two roll stands, each usually consisting of two columns, connected by crosspieces at their ends. The pillars and crosspieces frame an opening in which the bearing housings of the rolls are placed. Each roll stand can also be made in a single piece. Two roll stands or frames are connected with each other by connecting pieces and form together a complete rolling mill stand. Each roll stand or frame is further provided with a screw, a so-called mill screw, or other mechanism for adjusting the nip or mutual distance between the rolls. The parallelism of the roll axes can also be adjusted by individual setting of the mill screws.

Among alternative embodiments may be mentioned such in which each frame is replaced by two screws, holding the bearing housings together, and by which the distance between the bearing housings and thereby the nip is adjusted. A common feature is that the alteration of the nip simultaneously requires equally large adjustments of two or more roll setting means working in parallel, i.e. normally the movement of two or alternatively four screws at the same time.

The engineering practice of today is also distinguished by providing rolling mills with rolls made in one piece with a smooth surface, or in the case of groove rolling, with a greater or smaller number of grooves. The rolls are provided with trunnions mounted in bearings, at least one trunnion end being made for receiving the torque from the driving equipment.

The latter method of design requires that the choice of material and material properties for the roll must be a compromise between desired properties concerning wear resistance of the roll surface and grooves on the one hand, and bending and torsional strength on the other hand, for the entire roll taking up rolling forces and rolling torque.

The conventional design brings with it both considerable down-time in exchanging rolls and grooves, and in losses on the roll costs side, as it is often necessary in small batch rolling to re-grind rolls when only one or two grooves have been used on a roll having several grooves. Nowadays there is indeed a rolling mill type, so-called block mills, in which roll rings are used, which are attached to a cantilever shaft, but this rolling mill type is burden with several disadvantages, amongst which may be mentioned low load capacity and large deflection. A hydraulic press is conventionally designed in the form of a structure having a fixed lower table and a fixed upper frame portion connected by columns, which at the same time form guides for the movable upper table. The presses are usually made with relatively long strokes, a large part of the stroke being the idling part required to get the workpiece easily between the upper and lower tools and to make room for taking out the pressed detail.

The conventional press therefore works in the following manner: When the upper table is in the raised position, the workpiece is placed in position. The upper table is now quickly brought down into contact with the workpiece, hydraulic liquid at a low pressure being supplied via a valve for rapid table movement. This movement requires large valves and large pipe dimensions. In the next operation the rapid movement valve is closed and a high pressure valve is opened, via which hydraulic liquid is supplied for the working stroke. The return stroke takes place with the valves being opened in reverse order.

This method of working results in considerable disadvantages. Amongst other things, a complicated and expensive valve system is required, long constructional details are exposed to the effect of working pressure, causing relatively large elastic deformation or springiness, and there are long contact times causing large temperature shocks in the press tools. The system also requires large volumes of hydraulic liquid under pressure, which also causes much springiness.

The object of the invention is to accomplish a new and improved apparatus of the kind given in the introduction, in which the above-mentioned inconveniences are avoided to a large degree.

With the object stated above, an apparatus is provided for the plastic working of material, the apparatus comprising in combination a lower portion carrying a lower tool and upstanding bars, an upper portion in the form of a carriage mounted for gliding movement along the bars, said carriage supporting an upper tool intended for co-action with the lower tool, and different means for respectively displacing the carriage along the bars and for fixing the carriage to the bars in an optional position of displacement.

In the case where the apparatus according to the invention is designed as a rolling mill with horizontally arranged rolls, it suitably consists of a lower portion which is provided with four relatively heavy steel bars. Two bearing housings carrying a lower roll have been attached to the lower portion. A carriage or table gliding on the bars is provided with two bearing housings for carrying the upper roll.

This carriage and associated roll can be displaced in height with the help of a hydraulic cylinder mounted in a tie plate, attached to the upper ends of the steel bars.

The nip is adjusted by operating this cylinder. When the right position has been obtained, the carriage is fixed in the adjusted position with the aid of four expander sleeves, mounted in the carriage and working between it and the respective steel bar. Setting thus takes place by parallel adjustment of the movable carriage with only one operating means. Fixation by the use of expander sleeves means that only the portions of the steel bars situated under the expander sleeves are exposed to tensional stress during rolling. The more slender workpiece rolled, and consequently the smaller the nip which is set, the shorter the length taking strain will be, since shorter portions of the steel bars are exposed to tensional stress. This results in the attainment of increased precision in the rolling of more slender products, which is something to be desired. Combining the above-mentioned adjustment of the carriage with other adjustment is within the scope of the invention. For example, the nip can be finely adjusted, even while the mill is running, by adjustable wedging means working between the bearing housings of at least one horizontal roll and the portion of the rolling mill supporting said housings. These wedging means can also be individually adjustable for trueing-up one roll in relation to the other.

The rolls preferably consist of a roll shaft, provided with trunnions for supporting bearings, one trunnion being extended to receive a coupling half or other means for transferring rolling torque to the roll. The rolling surface is made as a ring and is attached to the shaft by an expander sleeve. The roll ring is hereby securely fastened to the shaft but can be quickly loosened by reducing the pressure in the expander sleeve. This method thus allows the choice of a shaft having high bending and torsional strength, while the material for the roll ring can be chosen for high resistance to wear, i.e. a material which is usually brittle, and sensitive to bending stresses. The bearing housings on the driving side are rigidly attached to their carrying means, while on the other hand the bearing housings away from the driving side are easily detachably attached, suitably with the assistance of quickly releasable clamping means.

The steel bars can also be used to carry one or two pairs of vertical rolls, arranged independently of the displacing movements of the carriage. Each vertical roll pair is suitably mounted in a frame structure taking up the forces on said rolls, which in its turn is carried by the upstanding bars. The distance between the rolls in each vertical roll pair can be fixed or adjustable under operation. These roll pairs are also, to advantage, designed for quick roll exchange. Each of the vertical rolls consists of a roll shaft and a roll ring, and the latter can be rigidly clamped with a special expander sleeve. In this case roll exchange can take place by freeing the attachment to the steel bars, whereat the vertical roll pairs can be capable of being swung out, and arranged to be lifted out and exchanged as a unit. Alternatively, the vertical roll pair can be so designed that the upper bearing housings can be detached and lifted up, so that the roll rings can be lifted out and exchanged, after the expander sleeves have been depressurized.

Figure 2:
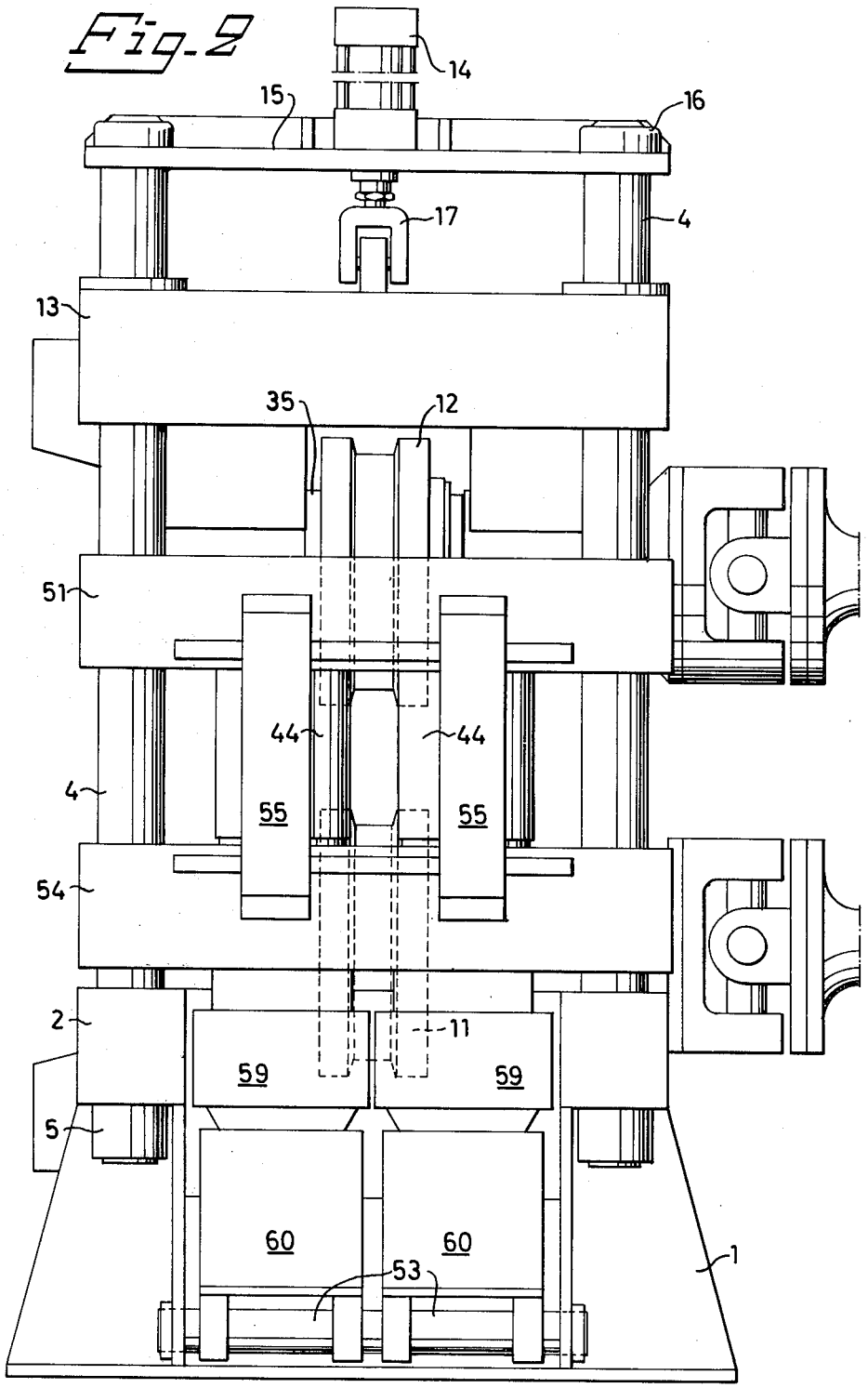
Figure 3:
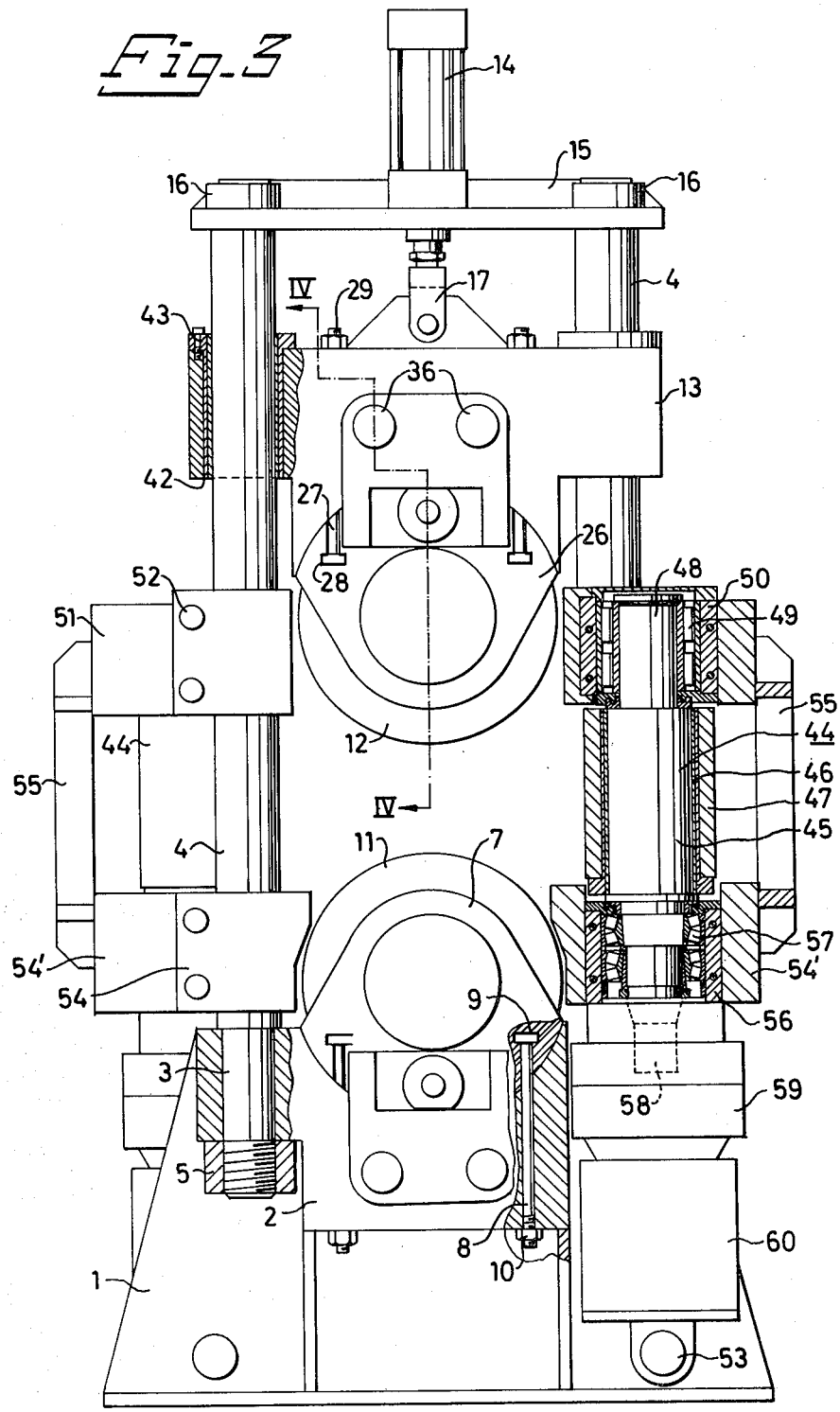
Figure 4:
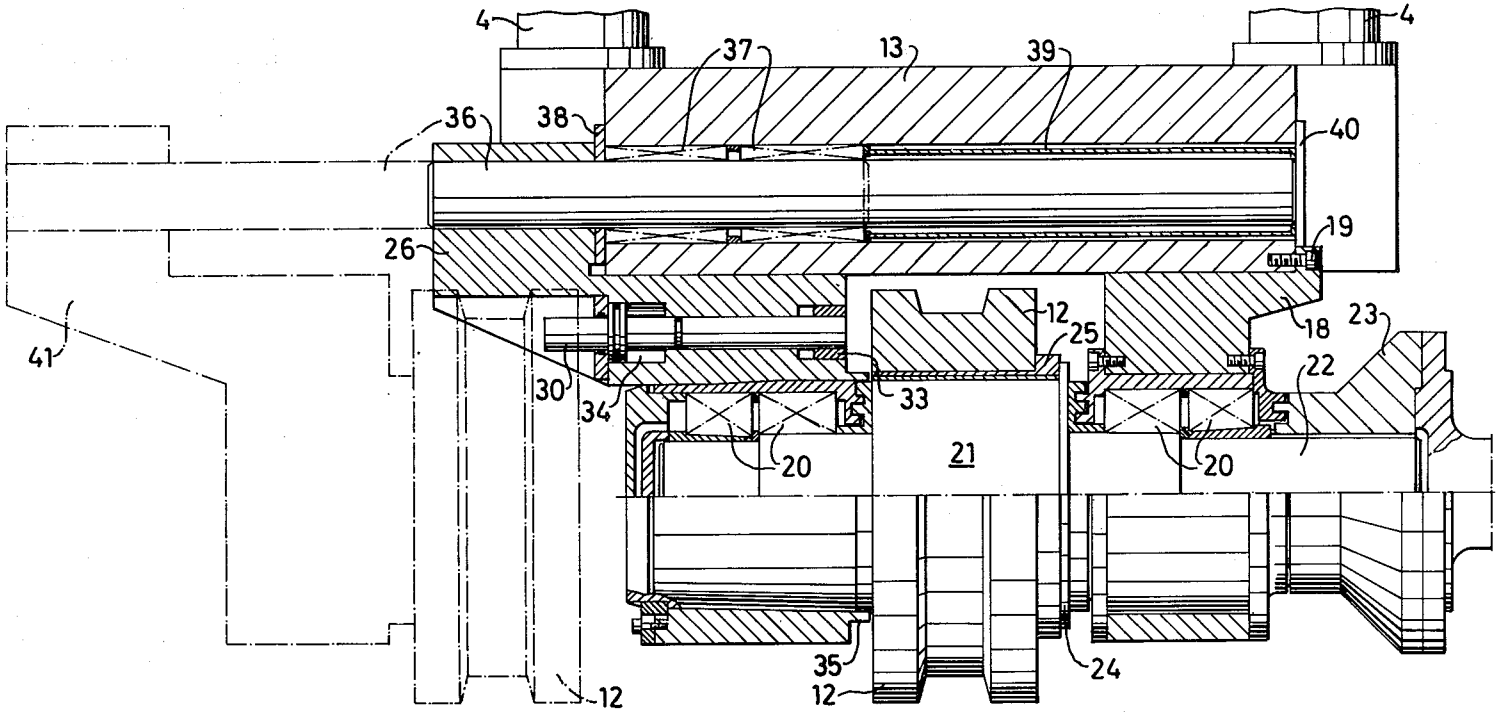
Figure 5:
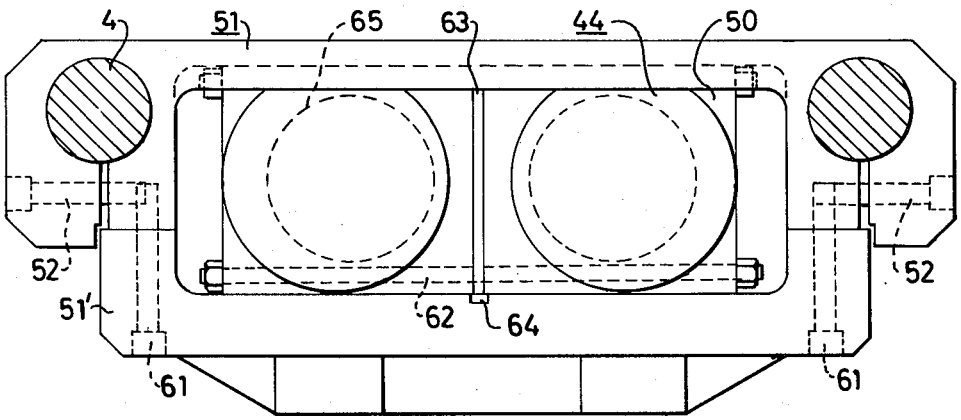
Figure 6:
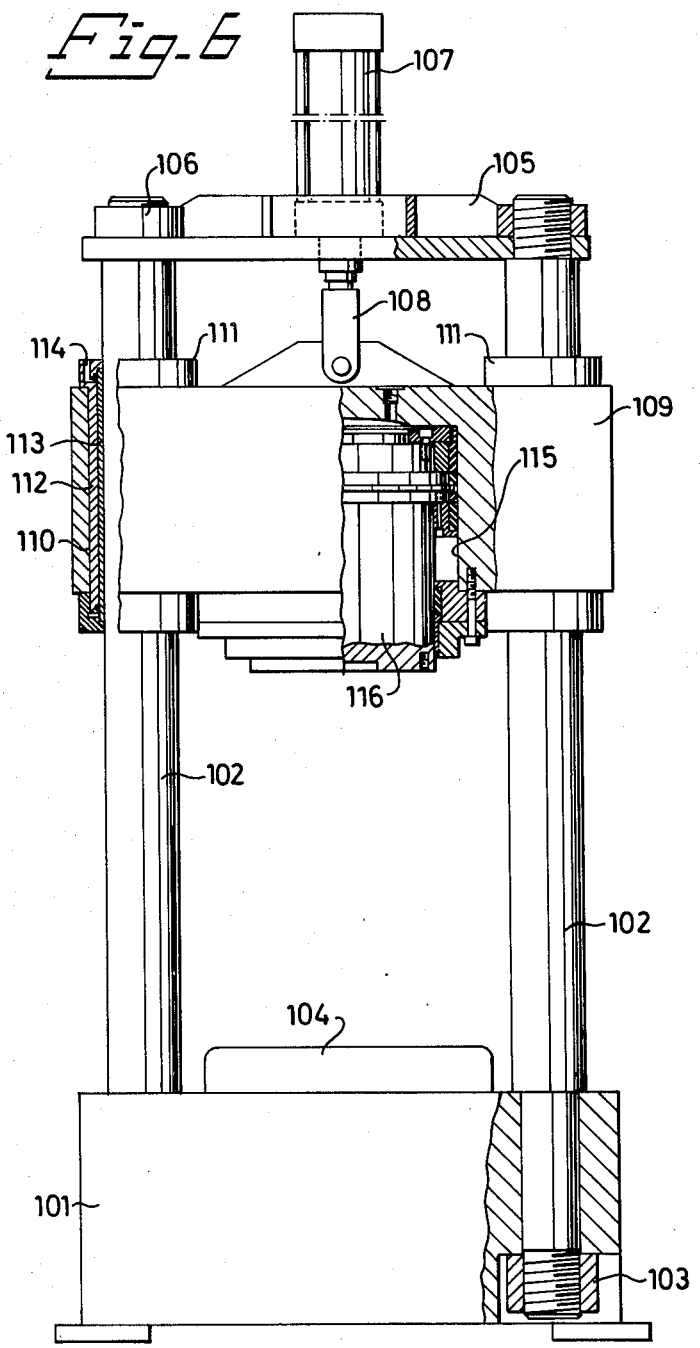

The invention will now be more closely described with reference to two embodiment examples shown on the appended drawing, whereat further distinguishing features of the invention will be apparent. FIG. 1 is a schematic perspective view of an embodiment of the invention designed as a rolling mill. FIG. 2 shows the rolling mill according to FIG. 1 in more detail as seen from the front. FIG. 3 shows the rolling mill according to FIG. 2, from the side away from the driving side, a vertical roll and an expander sleeve, amongst other things, being shown in section. FIG. 4 shows a section taken along line IV—IV in FIG. 3, through the upper roll, its journalling and the carriage carrying the upper roll. FIG. 5 shows a view from above of a vertical roll pair. FIG. 6 is a vertical view of an embodiment of the apparatus according to the invention in the form of a hydraulic press, certain portions being shown in section.

In the design shown in FIGS. 1–5 the rolling mill is built up on a frame 1 which includes a bottom portion or base 2. The latter is provided with four through holes 3 in which four steel rods or bars 4 are attached by nuts 5. The base 2 carries two bearing housings 6 and 7 for a horizontally arranged lower roll provided with an exchangeable roll ring 11, bearing housing 6 being fixedly mounted on base 2 by bolts (not shown). The bearing house 7 is clamped by bolts 8 and nuts 10, the bolts 8 being able to slide in T-slots in bearing housing 7, parallel to the roller axis. When nuts 10 are slackened, the bearing housing 7 can then be displaced sideways in relation to the rolling mill, for de-mounting roll ring 11. Mounting and demounting of the lower roll ring 11 takes place in the same way as for the upper roll ring 12, working in conjunction with it. The way in which this is done will be described below with reference to FIG. 4. An upper part 13 is designed as a carriage glidably mounted on steel bars 4, the carriage being capable of movement in a vertical direction with the assistance of a hydraulic cylinder 14, which is mounted on tie plate 15, which in its turn is permanently attached to bars 4 above carriage 13 by nuts 16. The ram of cylinder 14 is attached to the carriage 13 by a stirrup 17. Unions and pipelines for the supply of pressure medium to and from cylinder 14, as well as other cylinders and expander sleeves described below, have not been shown on the drawing figures for the sake of clarity.

Carriage 13 carries a bearing housing 18 (FIG. 4), fixedly mounted to the carriage and attached by bolts 19. The bearing housing contains two roller bearings 20 mounted on a roll shaft 21. A coupling half 23 is mounted on the driving extension 22 of the roll shaft 21. The roll shaft is provided with flange 24, against which abuts an expander sleeve 25, with the help of which the roll ring 12 is fastened. This expander sleeve, like all the expander sleeves mentioned in the following, is preferably designed in accordance with U.S. Pat. application Ser. No. 435728, filed Jan. 23, 1974. The expander sleeve chiefly consists of two tubes, the one pushed inside the other, their ends being sealingly in contact, and at least one of the tubes being thin-walled. A pressure medium can be introduced between the tubes by a (non-illustrated) connection to the space between the tubes, so that gripping can take place by at least one tube yielding in a radial direction for the applied pressure medium. Carriage 13 also supports a bearing housing 26 provided with roller bearings 20, said bearing housing being attached to the carriage by bolts 27 and nuts 29 (FIG. 3), the bolts 27 being able to slide in T-slots 28 in the bearing housing. When nuts 29 are slackened, the bearing housing can be moved sideways relative to the rolling mill for exchanging the roll ring 12. The following procedure is adopted here. The piston 30 is pushed into contact with the roll ring 12 by compressed air being applied to one side of the piston. The end of the piston is provided with an electromagnet 33 which is actuated, and fastens onto the roll ring 12, taking the ring with it when the piston is returned to its starting position by supplying compressed air to the other side of the piston, i.e. to the space 34. This is done first after the pressure in expander sleeve 25 has been lowered so that the roll ring 12 is no longer gripped by the expander sleeve. The roll ring 12 will now rest on flange 35.

The bearing housing 26 carries two steel bars 36, attached to it and capable of being pushed into carriage 13. To facilitate this movement the bars 36 are mounted in two rolling bearings 37 arranged in the carriage, the position of the bearings being fixed by the help of washer 38 and a tubular support 39, positioned by the help of an end plate 40. When the bearing housing 26 is pulled out to the end position 41 indicated by dotted lines, the roll ring 12 hangs freely from roll shaft 21, and can easily be exchanged for another.

The carriage 13 is provided with cavities or holes 42 (FIG. 3), carrying expander sleeves 43, gliding on bars 4. When the carriage has been moved by cylinder 14 to a desired height, the expander sleeves are actuated, pressing them against bars 4 and causing the carriage to be fixed relative to the bars, whereby the carriage then keeps its position even under the influence of rolling forces.

The bars 4 also carry two pairs of vertical rolls 44 with roll shafts 45 and expander sleeves 46 for attaching roll rings 47 to the roll shafts 45. On the upper rolls trunnions 48, bearings 49 are mounted in bearing houses 50, which are carried on an upper frame 51. Frame 51 is clamped to bars 4 by bolts 52. The bearing houses 56 for the lower bearings 57 are mounted in a similar manner in a lower frame 54. Frames 51, 54 each contain an outer frame portion 51', 54', removably attached by bolts 61. Frame portions 51', 54', are joined together by jointing pieces 55. To change a roll ring 47, the pressure in expander sleeve 46 is reduced, causing its grip to slacken and the roll ring 47 to be loosened. Clamping bolts 61 are loosened, whereafter the outer frame portions 51', 54' (FIG. 5) together with bearing housings 50, 56 are swung out about the hinge 53. The bearing housings 50 can now be withdrawn upwards and the roll rings exchanged.

The roll shafts 45 are provided at their lower ends with driving portions 58, inserted into a planet gears 59, driven by a hydraulic motors 60.

In accordance with FIG. 5 the bearing housings 50 of the vertical roll pairs are kept together by bolts 62. An exchangeable spacer 63 is arranged between the bearing housings 50, spacer 63 being kept in a predetermined position by there being, at least on one side of the frame, a slot 64 in which it is localized, or which it fills. The vertical roll nip can be adjusted by inserting spacers of different thickness. It is also within the scope of the invention to arrange the vertical roll nip adjustable while running, e.g. the vertical rollers can be journalled in eccentric collars as is indicated at 65 in FIG. 5, the collars being rotatable to adjust the nip.

The press according to FIG. 6 consists of a lower fixed portion or table 101, which is shown as supporting four steel bars 102, fixedly attached by nuts 103. The lower table carries, possibly via a tool holder 104 a lower (non-illustrated) tool. A tie plate 105 is attached to the upper ends of the steel bars 102 by nuts 106, the tie plate 105 carrying an operating means in the form of a hydraulic cylinder and ram means 107. This is attached to the upper movable press table 109 by a joint 108. The press table can glide vertically, the bars 102 functioning as guides. The press table is provided with through holes 110, in which are placed expander sleeves 111, consisting of an inner sleeve 112, gliding against the steel bars, and an outer sleeve 113 in contact with the walls of holes 110 in the press table 109. When hydraulic medium under pressure is supplied through connection 114, the sleeves are pressed tightly against the press table and steel bars, the table being fixed in a set position and being able to take up the pressing force caused by the pressing operation. The upper table 109 is provided with a bore 115, in which has been placed a double-acting cylinder and ram device, with ram 116, functioning as a holder for an upper tool, or pressure-exerting means if a complete press tool is installed on the lower table 101. The last-mentioned cylinder and ram device has a comparatively short stroke, with the ability to exert a comparatively large force, while the first-mentioned cylinder and ram device 107 has a comparatively large stroke but can only exert a comparatively small force.

This hydraulic press therefore has the feature that it can be made with a simple, quick and cheap operating mechanism for long idling strokes. The working system, e.g. a hydraulic system for high working pressure, is completely separated from the idling system. This also implies the advantage that as soon as ram 116 has arrived at its bottom position during the working stroke, the expander sleeve 111 can be unloaded and the upper table 109 quickly withdrawn from engagement with the workpiece. Contact time can hereby be reduced, which is of the greatest importance in heat smithing, since increased contact times are a reason for increased tool wear and tool break downs.

The invention is not limited to the embodiments described above with reference to the appended drawings, and the design of the invention can be modified in many ways within the scope of the following claims.

We claim:

1. An apparatus for plastic working of material, comprising in combination a lower portion carrying a lower working roll and upstanding bars; and upper portion in the form of a carriage mounted on the bars for gliding movement along said bars and carrying an upper working roll intended for co-action with the lower working roll; means for displacing the carriage along the bars; and expander sleeves surrounding the bars and carried by the carriage, the expander sleeves being actuable to clamping engagement with the bars for fixing the carriage to the bars in an optional position of displacement.

2. An apparatus according to claim 1, wherein the displacing means is a cylinder and ram means connected between the carriage and a stationary attachment supported by the bars above the carriage.

3. An apparatus according to claim 1, wherein the expander sleeves are actuatable to both clamping grip with the bars and pressure engagement with the inner walls of the openings in the carriage surrounding the bars.

4. An apparatus according to claim 1 wherein a vertical roll pair, independent of the displacement movements of the carriage, is arranged at at least one side of the lower working roll and the upper working roll, the vertical rolls being mounted in eccentric collars which are rotatable for adjusting the nip.

5. An apparatus according to claim 4, wherein the vertical roll pairs are mounted in frame structures taking up the forces on the vertical rolls, said frame structures being carried by the upstanding bars.

6. An apparatus according to claim 1, wherein the rolls comprise roll shafts on which roll rings are mounted, said rings being detachably fixed on the roll shafts.

7. An apparatus according to claim 6, wherein the expander sleeves are carried by the roll shafts, surround the shafts and are actuatable to a pressure engagement on the inside periphery of the roll rings for the attachment of the roll rings.

8. An apparatus according to claim 7, wherein the expander sleeves are actuatable to both pressure engagement with the inside periphery of the roll rings and clamping grip with the outer periphery of the roll shafts.

9. An apparatus according to claim 6, wherein the rolls provided with detachably mounted roll rings have at one end bearing devices, at least the parts of which extending radially outside the inner periphery of the roll rings, are removable to permit quick roll ring exchange.

10. An apparatus according to claim 9, wherein said parts are mechanically interconnected, and displaceably guided in the rolling mill in the axial direction of the associated roll to a position, at which there is a distance exceeding the axial length of the roll ring between the roll shaft end and said parts.

* * * * *